United States Patent [19]

Coppola et al.

[11] 3,987,296

[45] Oct. 19, 1976

[54] SEARCHLIGHT

[75] Inventors: Albert Coppola, Scarborough; Richard Lambert, Portland, both of Maine

[73] Assignee: Danforth, Div. of Eastern Co., Portland, Maine

[22] Filed: Jan. 17, 1975

[21] Appl. No.: 541,716

[52] U.S. Cl. ..... 240/44; 240/44.2; 240/61.05; 240/61.11

[51] Int. Cl.[2] ..... F21V 7/00

[58] Field of Search ..... 240/61.11, 61.05, 61.9, 240/61.12, 61.13, 44.2, 44 R, 44.25, 61.7, 61.8, 61.6

[56] References Cited

UNITED STATES PATENTS

| | | | |
|---|---|---|---|
| 953,139 | 3/1910 | Hall | 240/61.05 |
| 1,551,805 | 9/1925 | Davis | 240/61.05 X |
| 1,779,953 | 10/1930 | Sklarek | 240/44.2 |
| 2,097,537 | 11/1937 | Snyder | 240/61.05 X |
| 3,267,274 | 8/1966 | Johnson | 240/44 X |

*Primary Examiner*—L. T. Hix
*Assistant Examiner*—E. M. O'Connor
*Attorney, Agent, or Firm*—Stefan M. Stein

[57] ABSTRACT

A remote control motor driven lamp with motors to drive the lamp assembly in two perpendicular planes and a motor to change the distance between the lamp filament and the reflector in such a manner as to vary the beam characteristics. The lamp is capable of being operated from at least one remote station enabling the operator to alter both the beam characteristics and the beam direction from the remote station.

14 Claims, 6 Drawing Figures

FIG. 1
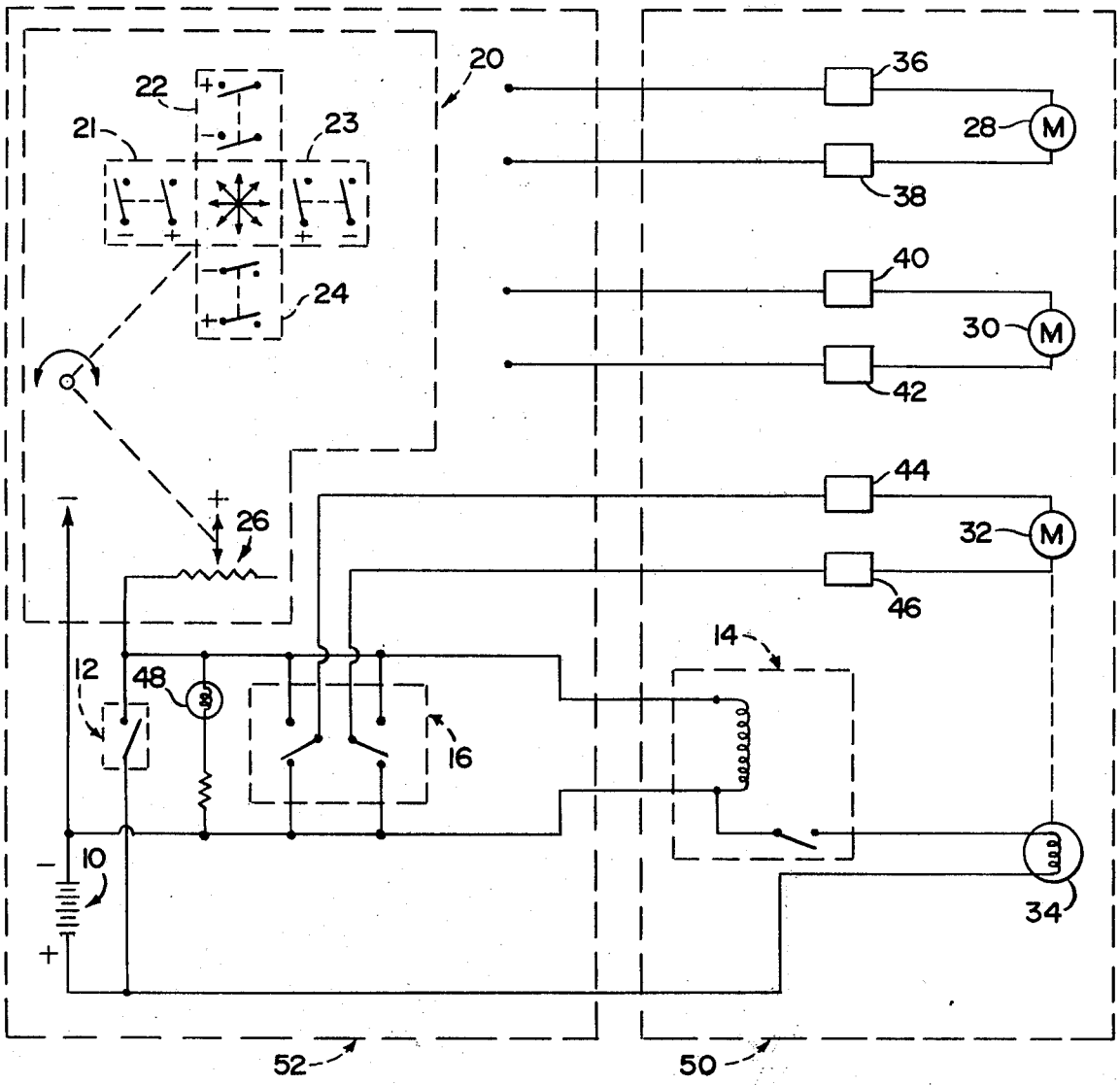
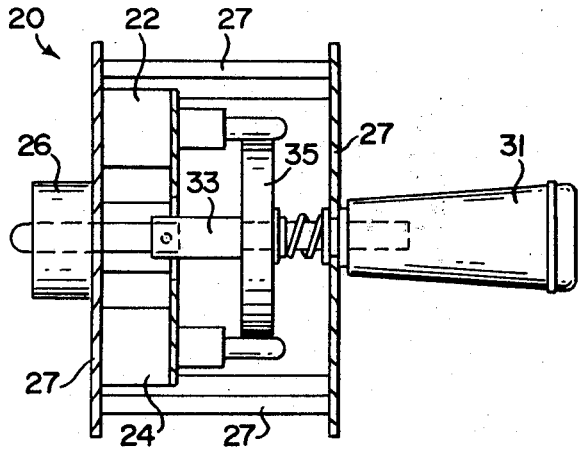
FIG. 5
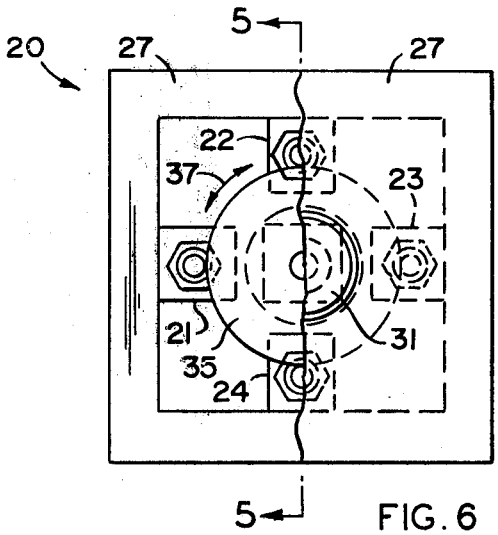
FIG. 6

SEARCHLIGHT

BACKGROUND OF THE INVENTION

1. Field of the Invention

A remote controlled motorized searchlight assembly including motor means operatively connected so as to change the position of the lamp beam and to vary the beam characteristics from spotlight to floodlight.

2. Description of the Prior Art

Presently, there exists any number of spotlights which are remotely controlled. Some are mechanically controlled and others are electrically controlled. Those which are mechanical in nature are limited in that the remote stations cannot physically be distant from the lamp itself. This is a serious drawback in many applications. Electrically driven lamps are large in size and frequently possess complex gearing to achieve universal motion.

A further disadvantage of prior art searchlights is their inability to efficiently alter beam characteristics as needed. Usually, there is either one lamp filament located in one position, thus giving only a predetermined beam characteristic, or there are two lamp filaments, one located so as to give a spotlight effect and the other located so as to give a floodlight effect. However, it is desirable in certain circumstances to be able to alter the beam characteristics in a continuous manner so as to achieve the precise beam characteristic desired.

Light structures of the type disclosed in U.S. Pat. Nos. 3,261,975 and 3,267,274 are generally representative of a number of prior art searchlight structures capable of having their beam characteristics regulated by regulating the position of the filament relative to either a reflector and/or lens element. However, accomplishment of filament displacement or positioning, in these types of structures is generally provided by overly complex drive or linkage assemblies. This, of course, results in prohibitively expensive devices frequently not suitable for certain applications.

Motorized remotely controllable light structures have particular applications in a marine environment, such as for use of ships and various water craft. Of particular importance in such environment is durability, reliability and efficient operation regarding positioning and delineation of beam characteristics.

Prior art motorized assemblies of the type capable of substantially universal positioning are generally represented by the structure disclosed in U.S. Pat. Nos. 3,644,732 and 3,267,274. While such commercially available light structure assemblies are generally usable as designed, they are frequently considered overly complex and therefore maintenance prone and expensive for many uses. In addition to durability and reliable operation in relatively harsh environments, light structures suitable for marine use should also be relatively compact or housed in an efficient space saving manner without sacrifice of performance characteristics. Thus, a need exists for a remote controlled motor driven searchlight with a structure capable of efficiently altering the direction of beam through light disposition and a method of altering beam characteristics continuously from spotlight to floodlight.

SUMMARY OF THE INVENTION

This invention relates to a motor driven remote controlled lamp searchlight capable of projecting a beam in almost any predetermined direction because of substantially universal disposition of the light head and also of varying characteristics of the beam projected. More specifically, the altering of the beam direction in the vertical plane is accomplised by a motor driven scissor-type linkage means connected to the lamp housing, and a focus adjustment means by a motor connecting the reflector means and the lamp filament means such that the distance between the two can be continuously varied.

Vertical adjustment is accomplished by a screw threaded portion formed on a motor shaft. Movement of the lamp head portion of the light assembly is accelerated by a scissor design concept to be further described hereinafter. The motor is mounted on one arm which is rigidly fastened to cylinder means which passes through the lamp housing and is rigidly affixed to the searchlight mounting yoke. Rigidly affixed to the searchlamp housing and surrounding said cylinder means is a sleeve upon which a second arm is rigidly affixed. On the end of this second arm is a threaded, rotatable stud which serves as the drive point. The stud has a threaded aperture which receives the threaded drive shaft from the motor mounted on the first arm. As the motor rotationally drives the threaded shaft, the second arm moves in the vertical plane. This arm, being attached to the lamp housing assembly, causes the lamp head position and the projected beam to move in the vertical plane.

Motion of the lamp head position and the projected beam in the horizontal plane is accomplished by a motor means affixed inside the searchlight base and connected to the searchlight base in such a manner that the searchlight yoke and thus the entire searchlight housing may rotate in the horizontal plane. Any other applicable structure may also be utilized to accomplish motion in the horizontal plane.

A significant advantage of the searchlight invention is that alteration of beam direction and the speed of alteration of beam direction is controlled by a single, remotely located, switch means. Further, there may be more than one such remote switch means. The switch means will allow the lamp to be driven in a horizontal or vertical plane, or both planes simultaneously. The speed with which the lamp is driven can be varied by the same switch. This has the great advantage of permitting the operator total control of the lamp's movement with one hand. Essentially, the switch means is a single multi-positioned rotatable "joy-stick."

An important feature of the present invention is the capability of the characteristic of the beam being variable from spotlight to floodlamp. This is achieved by means of motor means connected in relation to a threaded shaft to which the lamp filament is connected. The lamp filament may be a lightbulb. The drive shaft runs along the center line of the reflector. Thus, as the lamp filament moves along this center line the beam characteristic varies according to the relative position of the filament and reflector.

In the remote station there are push button switch means which control the direction in which the motor is driving the lamp filament.

The motion of the projected beam of the lamp is limited in the horizontal and vertical planes by a plurality of limit switch means. The distance of travel of the lamp filament in relation to the reflector means is limited by a plurality of limit switch means.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a schematic diagram of search lamp electrical control circuit means of the present invention.

FIG. 5 is a top view of the "joy-stick" switch means.

FIG. 6 is a side view of the "joy-stick" switch means at 1—1 of FIG. 5.

Similar reference characters refer to similar parts throughout the several views of the drawings.

DETAILED DESCRIPTION

Figure 2:
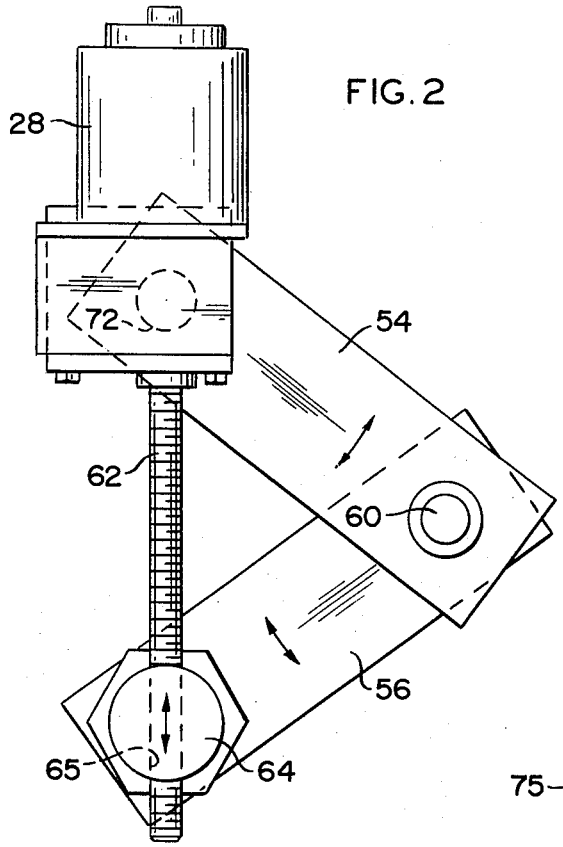
FIG. 2 is a plan view of the vertical adjustment drive means.

FIG. 1 shows the schematic diagram of the lamp electrical circuit. Power source means 10 may be a battery, generator, or other power source means. When switch means 12 is activated by an operator, pilot light means 48 and power relay means 14 are energized. When power relay means 14 is activated, current from power source means 10 flows through searchlight filament means 34. The searchlight beam is thus activated. Filament means 34 may comprise conventional or commercially available bulb structure.

When switch means 12 is in the energizing position, current flows to switch means 20. Switch means 20 comprises individual switch means 21, 22, 23 and 24, and potentiometer means 26. The structure of switch means 20 is more fully described below. Switch means 20 controls the direction of motion and speed of vertical drive motor means 28 and horizontal drive motor means 30. When switch means 20 is set in a vertical upward position, vertical adjustment motor means 28 drives searchlight housing means 76 upward in the vertical plane. When switch means 20 is set in the vertical-downward position, vertical adjustment motor means 28 drives searchlight housing means 76 in a downward direction in the vertical plane. Likewise, when switch means 20 is set to the right, horizontal adjustment motor means 30 to drive searchlamp housing means 76 in a clockwise direction in the horizontal plane as seen by an observer looking in the direction the beam is projected. When switch means 20 is set to the left as represented in the drawings, horizontal adjustment motor means 30 drives the searchlamp housing means 76 in a counterclockwise direction in the horizontal plane as seen by an observer looking in the direction the beam is projected. Switch means 20 may also be positioned to simultaneously energize vertical and horizontal drive motor means 28 and 30. This causes searchlamp housing means 76 to move clockwise-up, clockwise-down, counterclockwise-up or counterclockwise-down. Further, by rotation of handle means 31 of switch means 20, potentiometer means 26 causes the current flowing and thus the speed of vertical and horizontal drive motor means 28 and 30 to vary.

Filament adjustment motor switch means 16 has a plurality of positions. In the present embodiment means 16 is a two positioned switch, however, there may be more positions. When in a first position, filament adjustment motor switch means 16 energizes focus adjustment motor means 32 to drive searchlight filament or bulb means 34 away from reflector means 80. When filament adjustment motor switch means 16 is in a second position, focus adjustment motor means 32 is energized so as to drive searchlight bulb means 34 toward reflector means 80.

Limit switch means 36 and 38 are positioned on the path of vertical adjustment motor means 28 so that when the searchlight housing has been driven to a preset maximum or minimum position, vertical motor adjustment means 28 is de-energized. Limit switch means 40 and 42 are positioned such that when horizontal adjustment motor means 30 has reached preset maximum or minimum the motor means 30 is de-energized. Limit switch means 44 and 46 respectively are positioned such that when focus adjustment motor means 32 has driven searchlight filament or bulb means 34 to preset maximum or minimum focus adjustment motor means 32 is de-energized. Limit switch means 36, 38, 40, 42, 44 and 46 serve to limit the physical position of either searchlight housing means 76 or the searchlight bulb mean 34 to within specific preset positions.

Figure 3:
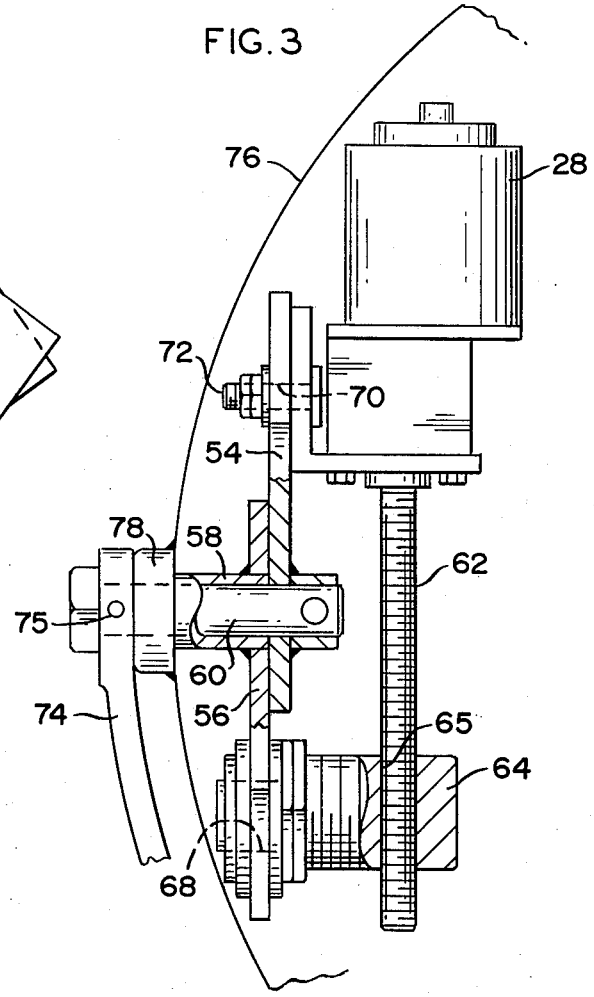
FIG. 3 is a side view of the embodiment of FIG. 2.

Vertical adjustment drive means is shown in FIGS. 2 and 3. Vertical adjustment motor means 28 is rigidly affixed to motor mounting arm means 54. More specifically, means of affixation of vertical adjustment motor means 28 to motor mounting arm means 54 is by bolt means 72 passing through hole means 70, thus linking vertical adjustment motor means 28 to motor mounting arm means 54. Motor mounting arm means 54 is rigidly affixed to housing mounting cylinder means 60. Housing mounting cylinder means 60 passes through hole means 75 in searchlight mounting yoke means 74, and through hole means 78 in searchlight housing means 76. Housing mounting cylinder means 60 is rigidly affixed to searchlight mounting yoke means 74. Outer sleeve means 58 is rigidly affixed to searchlight housing means 76 and cylindrically surrounds housing mounting cylinder means 60 such that the searchlight housing means 76 and affixed outer sleeve means 58 may rotate freely about housing mounting cylinder means 60. Rigidly attached to outer sleeve means 58 is housing drive arm means 56. Housing drive arm means 56 extends outward from around housing mounting cylinder means 60. Through hole means 68 in housing drive arm means 56 passes threaded rotatable stud means 64. Threaded rotatable stud means 64 has threaded hole means 65 which receives screw threaded motor drive shaft means 62 from vertical adjustment motor means 28.

In operation, when vertical adjustment motor means 28 is energized, it rotates screw threaded motor drive shaft means 62. The turning of threaded drive shaft means 62 in threaded rotatable stud means 64 drives housing drive arm means 56 in the vertical plane. Since housing drive arm means 56 is rigidly attached to searchlight housing means 76 by outer sleeve means 58, searchlight housing means 76 rotates about housing mounting cylinder means 60. This serves to provide motion of the searchlight beam in the vertical plane.

Figure 4:
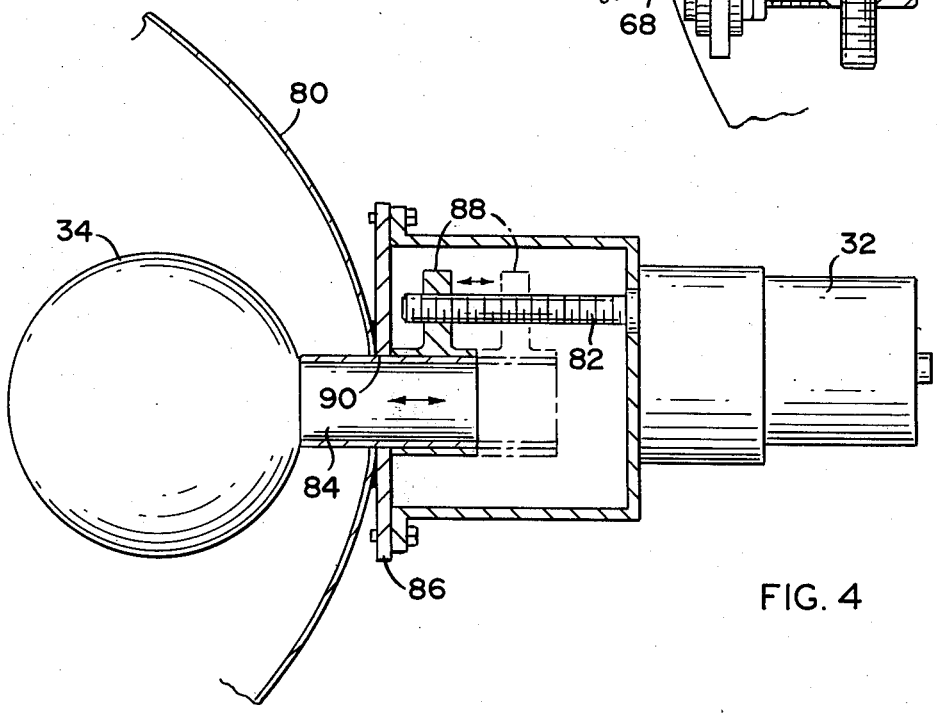
FIG. 4 is a side view in substantial detail of the adjustment drive means.

The filament adjustment drive means is shown in FIG. 4. Reflector means 80 is rigidly affixed to searchlight housing means 76. Motor mount means 86 is rigidly affixed by any applicable connector assembly adaptable to the structure of the present invention to parabolic reflector means 80. Filament drive motor means 32 is rigidly affixed to motor mount means 86. Extending from filament drive motor means 32 is threaded drive shaft means 82. Threaded drive shaft means 82 passes through threaded aperture means 88. Threaded aperture means 88 is affixed to searchlight socket assembly means 84. The searchlight filament or bulb means 34 is affixed to searchlight socket assembly means 84 by means well known in the industry. Rigidly affixed to the searchlight socket assembly means 84 is threaded aperture means 88. Searchlight socket assembly means 84 passes through hole means 90 in motor mount means 86.

When filament or bulb motor means 32 is energized it causes threaded drive shaft means 82 to rotate. Drive shaft means 82 passes through threaded aperture means 88, and as threaded drive shaft means 82 rotates, threaded aperture means 88 traverses said threaded drive shaft means. This has the effect of causing searchlight filament or bulb means 34 to move in relation to parabolic reflector means 80. This alters the beam characteristic continuously from flood to spot.

The structure of switch means 20 is detailed in FIGS. 5 and 6 support means for switch means 20 is generally indicated as 27. Any structure which provides a stable platform for the operation of switch means 20 is adequate. Shaft means 33 of switch means 20 is flexibly held in structure means 27. Fixedly attached to the mid portion of shaft means 33 is disc means 35. Handle means 31 is fixedly attached to one end of shaft means 33 and the other end of said shaft means 33 is fixedly attached to potentiometer means 26. As handle means 31 is rotated, as indicated by directional arrows 37, potentiometer 26 regulates the current flowing to horizontal and vertical drive motor means 28 and 30.

Handle means 31 attached to shaft means 33 is flexibly mounted in support means 27 and may be pushed so as to cause disc means 35 to push the toggles of individual toggle switch means 21, 22, 23 and 24 to an "on" position. Said toggle switch means 21, 22, 23 and 24 are spring loaded such that when disc means 35 ceases to exert pressure, a switch returns to an "off" position. Disc means 35 is positioned such that toggle switch means may individually be set in the "on" position, or may be set in the "on" position in pairs of switch means 21-22, 22-23, 23-24 or 24-21. The structure of switch means 20 is such that an operator need only use one hand to control the direction and change of direction of the projected beam of light from the searchlamp.

It will thus be seen that the objects set forth above, among those made apparent from the preceding description, are efficiently attained, and since certain changes may be made in carrying out the above method and article without departing from the scope of the invention, it is intended that all matter contained in the above description shall be interpreted as illustrative and not in a limiting sense.

It is also to be understand that the following claims are intended to cover all of the generic and specific features of the invention herein described, and all statements of the scope of the invention which, as a matter of language might be said to fall therebetween. Now that the invention has been described,

What is claimed is:

1. A remote controlled motor driven lamp assembly for the projection of a searchlight beam comprising: lamp housing means, reflector means attached to said lamp housing means, lamp filament means disposed in a spatially predetermined relation to said reflector means, yoke means rotatably attached to said lamp housing means and disposed in supporting relation thereto, at least one drive motor means, first arm means rigidly affixed at one end to said yoke means, and said drive motor means disposed in driving engagement with the other end of said first arm means, second arm means rigidly affixed at one end to said lamp housing means and said drive motor means disposed in driving engagement with the other end of said second arm means, whereby activation of said motor means rotates said lamp housing means relative to said yoke means so as to provide motion of the searchlight beam.

2. A lamp assembly as in claim 1 wherein said lamp housing means further comprises an outer sleeve portion integrally formed thereon and rigidly affixed to said second arm means, said yoke means further comprising a cylinder portion integrally formed thereon and rigidly affixed to said first arm means, said outer sleeve portion disposed in surrounding relationship to said cylinder portion and in rotatable engagement therewith.

3. A lamp assembly as in claim 1 wherein said drive motor means further comprises motor drive shaft means protruding therefrom and disposed in driving relation to said second arm means, said second arm means further comprising stud means having aperture means formed therein, said motor drive shaft means disposed in protruding relationship within said aperture means and in rotatable engagement therewith.

4. A lamp assembly as in claim 3 wherein said motor drive shaft means further comprises a first threaded portion integrally formed thereon, said aperture means comprises a second threaded portion formed on the interior surface thereof and disposed in rotatable engagement with said first threaded portion.

5. A lamp assembly as in claim 1 further comprising focus motor means connected in driving relation between said lamp filament means and said reflector means.

6. A lamp assembly as in claim 5 wherein said focus motor means further comprises connector means protruding therefrom and drivingly engaging said lamp filament means.

7. A lamp assembly as in claim 6 wherein said connector means includes a connector threaded portion integrally formed thereon, said lamp filament means includes a threaded aperture portion integrally formed therein and disposed for rotatable engagement with said connector threaded portion.

8. A lamp assembly as in claim 5 further comprising a plurality of remote control means electrically connected to said focus motor means whereby activation of said remote controlled means regulates the distance between said lamp filament means and said reflector means.

9. A lamp assembly as in claim 1 further comprising a plurality of remote control means electrically connected to said drive motor means whereby activation of said remote controlled means regulates the rotation of said lamp housing means.

10. A lamp assembly as in claim 9 wherein at least one of the plurality of remote control means comprises a means remotely connected to energize and de-energize said drive motor means.

11. A remote control switch as in claim 10 wherein a plurality of positions of said switch means energize said drive motor means.

12. A remote control switch as in claim 10 futher comprising means to vary the speed of said drive motor means.

13. A lamp assembly as in claim 1 further comprising first limit switch means disposed in path interrupting relation to the path of travel of said lamp filament means.

14. A lamp assembly as in claim 1 further comprising second limit switch means disposed in path interrupting relation to said path of travel of said lamp housing means.

* * * * *